United States Patent [19]

Thorn

[11] 4,329,827

[45] May 18, 1982

[54] ROOFING ELEMENTS

[75] Inventor: Ake Thorn, Rundviksverken, Sweden

[73] Assignee: Masonite AB, Rundviksverken, Sweden

[21] Appl. No.: 147,071

[22] Filed: May 6, 1980

[51] Int. Cl.[3] ..... F04C 2/34

[52] U.S. Cl. ..... 52/793; 52/807; 52/809; 52/731

[58] Field of Search ..... 52/793, 807, 809, 827, 52/810, 270, 271, 404, 731, 690

[56] References Cited

U.S. PATENT DOCUMENTS

| | | | |
|---|---|---|---|
| 1,075,845 | 10/1931 | Mills | 52/731 |
| 2,864,132 | 12/1958 | Clements | 52/809 X |
| 3,732,138 | 5/1973 | Almog | 52/807 X |
| 4,244,151 | 1/1981 | Seem | 52/404 X |

FOREIGN PATENT DOCUMENTS

| | | | |
|---|---|---|---|
| 233617 | 4/1961 | Australia | 52/807 |

*Primary Examiner*—Carl D. Friedman

*Attorney, Agent, or Firm*—Cushman, Darby & Cushman

[57] ABSTRACT

A roofing element is described which comprises two spaced skins, an upper skin of relatively thick non-metallic sheet material, such as plywood or chip board, and a lower skin of sheet metal, for resisting compression stresses in the upper skin and tension stresses in the lower skin. The skins are bonded to spacing members extending in the lengthwise direction of the element and provided by composite beams of non-metallic or substantially non-metallic material, having webs of wood-based board material and flange members of wood. The spaces between the skins are filled up with a thermally insulating material, such as mineral wool or foamed uretane plastic.

12 Claims, 6 Drawing Figures

ROOFING ELEMENTS

BACKGROUND OF THE INVENTION

This invention relates to roofing elements and more particularly but not exclusively to roofing elements having a great span length for the construction of roofs for factory buildings and the like.

U.S. Pat. No. 1,075,845 (Mills) discloses a structural material made up of two parallel spaced wooden members united by upper and lower skins of sheet metal. This material, if used for roofing, is subjected to compression stresses which have to be taken up almost completely by the wooden members, since the sheet metal upper skin would be easily overstressed otherwise. Accordingly, the wooden members must be of ample cross dimensions, entailing a great expenditure of wood. Further, the massive wood components will form heat-conducting bridges between the inside and outside.

German Patent Specification No. 812,834 discloses a hollow all-wood construction element having both outer skins of wood-based board material and the distance members formed by composite beams having flanges of wood and webs of board material. Being an all-wood structure this element lacks fireproofing, contrary to that one afforded by a sheet metal skin. This structure will also involve a weight penalty due to the provision of two relatively thick outer skins.

Swedish Patent Specification No. 385,603 provides a construction element having an upper skin of plywood or the like and bottom members of channel-shaped sheet metal profiles bonded to the upper skin. The metal profiles will form extensive heat-conductive bridging and do only extend opposite parts of the upper plywood skin whereby fire-proofing becomes ineffectual.

SUMMARY OF THE INVENTION

It is an object of the invention to provide a roofing element of light-weight construction capable of taking up great loads over important span lengths.

A further object is to provide a roofing element using non-metallic material to withstand compression stresses and sheet metal for taking up tension stresses and for fire-proofing.

A still further object is to provide a roofing element wherein heat-conducting bridges are virtually eliminated.

To attain these and further objects the invention provides a roofing element having a relatively thicker upper skin for taking up compression stresses, a relatively thinner lower sheet metal skin for taking up tension stresses and spacing members bonded to both skins and extending in the lengthwise direction of said element, said spacing members being composite beams of non-metallic or substantially non-metallic material comprising flange portions and interconnecting, relatively thin webs.

DESCRIPTION OF THE PREFERRED EMBODIMENTS

Figure 1:
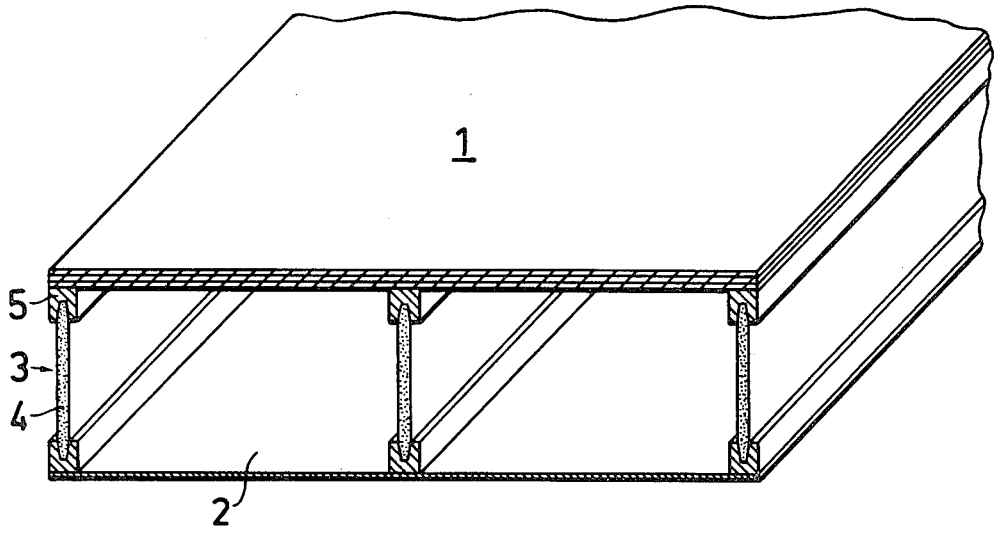
FIG. 1 is a partial perspective view of a roofing element according to the invention.
Figure 2:
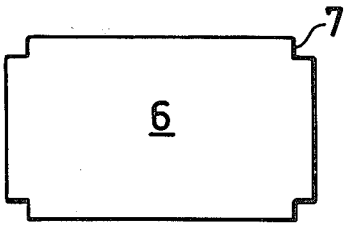
FIG. 2 is a top plan view of a stiffening intermediate wall.

The roofing element illustrated in FIG. 1 comprises two spaced outer skins 1 and 2, an upper skin or sheet 1 of plywood or the like having a thickness between 6 and 25 millimeters and preferably of the order of 15 millimeters and a lower sheet metal skin 2. The lower or bottom skin 2 will not be subject to compression stresses when forming part of a roof and thus can be a thin gauge steel or metal plate, in the order of 0.4 to 1.0 millimeters. The overall length of the roofing element may be as great as 12 meters.

Between the skins 1 and 2 there are interposed spacing and force transmitting composite beams 3 which extend lengthwise of the element and are bonded by their flange or rim wooden portions 5 to the skins. The bonding agent may be a glue or adhesive cement alone or in combination with nails. The beams 3 have an I-shaped profile and have web portions 4 of a fibrous wood-based material and flanges 5 of wood. The webs 4 have tapered edge portions which engage corresponding grooves in the flanges and are secured therein by a bonding agent so as to form a rigid unit therewith.

In the embodiment shown, three I-beams 3 are provided, one at each lateral side of the element and along the middle.

For increasing lateral stiffness board sheets 6 having recessed corners 7 for accommodating the beam flanges may be fitted inside the elements. Like the thin webs 4 of the beams 3 they gave a very low thermal conductivity, whereby, contrary to metal profiles or metal framework, they do not provide heat-conducting paths right through the elements.

Figure 3:
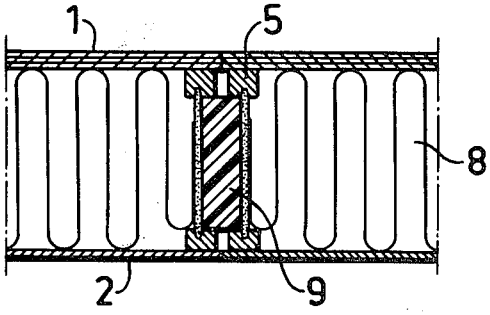
FIG. 3 is a cross section view of a joint between two roofing elements.

The regular-shaped spaces defined between the skins 1 and 2 and beams 3 and sheets 6, when provided, are filled by insulating mats 8 of mineral wool or the like (FIG. 3). As can be seen, the insulating material need only be recessed at the lateral edges, corresponding to the size and shape of the flanges 5. The shaping of the insulation as well as the fitting thereof is easily carried out, therefore. Alternatively, the insulation may be rigid and bonded to the surrounding material, thereby increasing stiffness. Such insulation may be a foamed urethane plastic injected into the spaces. This compound can also be used in the lateral joints between elements (FIG. 3), to form a body 9 keying two elements laterally together by filling out the space between the webs and flanges of two parallel beams belonging to two juxtaposed elements.

Figure 4:
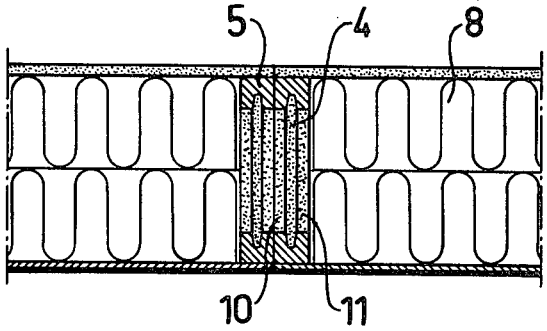
FIG. 4 illustrates an alternative mode of joining two elements.

In FIG. 4 there is illustrated another embodiment of the lateral joint between two roofing elements. In this structure the interspace between the webs 4 and flanges 5 and also the opposed lateral recesses have been filled out with board strips 10 and 11, respectively. This will make for good thermal insulation of the joint.

Figure 5:
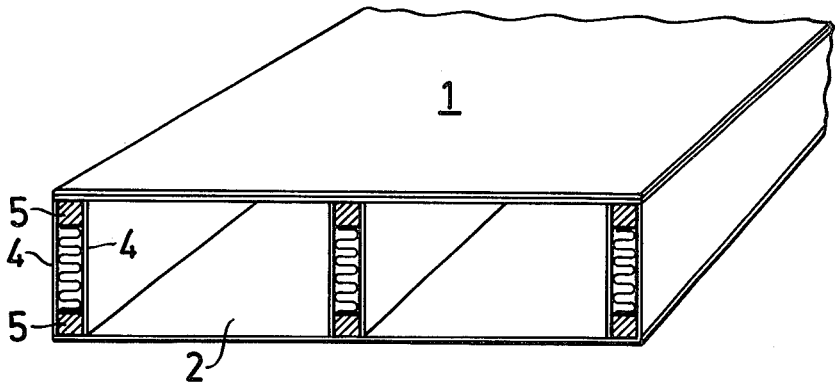
FIG. 5 is a partial perspective view of a second embodiment.

A second embodiment of a roofing element according to the invention is illustrated in FIG. 5. This element has spaced upper and lower skins 1, 2 like those already described in conjunction with FIG. 1, whereas the intermediate beam members are box-like structures having lateral webs 4 of board strips joined to wooden members 5 corresponding to the I-beam flanges 5. The internal spaces of the beams are filled out with an insulating material, as are, although not illustrated, the spaces defined between the webs 4 and the skins.

Figure 6:
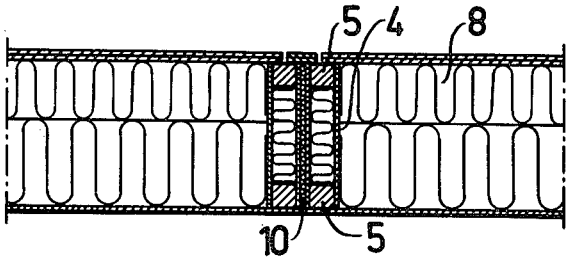
FIG. 6 is a cross section view of a joint between two elements similar to that one in FIG. 5.

In FIG. 6 there is illustrated a joint between two roofing elements of the kind described in the foregoing paragraph. In this example the upper skin of both elements covers only about half the width of the outermost beam members. The actual juncture between the elements is covered by a longitudinal strip. Insulation 10 may also be fitted between the adjoining lateral faces.

A roof constructed of elements according to the invention must be covered by a protective layer, such as roofing felt, plastic or sheet metal. This layer has no load-carrying function, since the roofing elements are rigid in themselves. The roof is protected against fire by the metal sheeting at its underside, and this sheeting also forms an effective barrier against the diffusion into the element of humidity.

The number of beam members for each roofing element is dependent on the width of the element. It may be five for a width of about 2.4 meters. A standard width is 1.2 meters, when three beam members are provided. The upper skin may consist of chip boarding or other wood-based board material instead of plywood.

The invention is not restricted to the specific embodiments described and illustrated but can be varied and modified within the scope of the appended claims.

What I claim is:

1. A construction element such as a roofing element for great span lengths comprising two substantially flat outer skins wholly spaced apart by distance members interconnecting said skins, said outer skins being of different thickness and of different materials, the upper skin being of a relatively thicker non-metallic material and the lower skin being of a relatively thinner metallic sheet material, for taking up compression stresses in the upper skin and tension stresses in the lower skin, said distance members comprising parallel composite beams of non-metallic material and having relatively wide flange portions and interconnecting relatively thin web portions, said flange portions being bonded directly to said skins by glueing or cementing in combination with nailing.

2. A constuction element as claimed in claim 1 wherein said upper skin is of plywood.

3. A construction element as claimed in claim 1 wherein said composite beams comprise I-beams having a web of wood-fibre board and flanges of wood.

4. A construction element as claimed in claim 1 wherein said composite beams comprise box-like structures having lateral portions of wood-fiber board and rim portions of wood.

5. A construction element as claimed in claim 4 wherein insulation is provided within said box-like structures.

6. A construction element as claimed in claim 1 wherein a soft insulation is fitted in the interspace between said skins.

7. A construction element as claimed in claim 1 wherein a rigid insulation is provided in the interspaces between said skins and is bonded to internal element surfaces.

8. A construction element as claimed in claim 1 wherein transversal reinforcing panels are secured within the interspaces between said skins and at right angles to said composite beams.

9. An assembly of construction elements as claimed in claim 1 wherein each construction element has an outer composite beam at an edge thereof and the construction elements are arranged so that the outer beam of one element adjoins the outer beam of an adjacent element with a space between adjoining beams and wherein insulation is provided in said space, said insulation comprising an injected hardening compound.

10. An assembly as in claim 9 wherein the hardening compound is urethane plastic.

11. An assembly of construction elements as in claim 1 wherein each construction element has an outer composite beam at an edge thereof and the construction elements are arranged so that the outer beam of one element is adjacent the outer beam of an adjacent element and wherein insulation is provided between the adjacent outer beams, said insulation comprising strips of fibrous material.

12. A construction element as in claim 1, wherein the upper skin is laminated plywood and the lower skin is a single ply of metal.

* * * * *